United States Patent [19]

Sonneborn

[11] 4,429,529

[45] Feb. 7, 1984

[54] HYDRAULIC CONTROL SYSTEM HAVING RECIPROCATING PUMP AND HANDLE OPERATED ROTATING VALVE

[75] Inventor: Lambertus J. Sonneborn, Oldenzaal, Netherlands

[73] Assignee: Applied Power Inc., Milwaukee, Wis.

[21] Appl. No.: 323,391

[22] Filed: Nov. 20, 1981

[51] Int. Cl.[3] ..... F01B 29/08; F15B 11/08

[52] U.S. Cl. ..... 60/433; 91/467; 417/442

[58] Field of Search ..... 417/442; 91/420, 467, 91/445; 60/433

[56] References Cited

U.S. PATENT DOCUMENTS 1,897,075 2/1933 Samson ..... 91/467

2,517,164 8/1950 Arps ..... 91/420 X

*Primary Examiner*—Richard E. Gluck

*Attorney, Agent, or Firm*—John J. Byrne; Bradford E. Kile

[57] ABSTRACT

Disclosed is a compact rotating hydraulic drive comprising (a) a housing, (b) a pumpshaft mounted in the housing for both linear translational and rotational movement, (c) a plurality of pumping units operated by rotational motion of the pumpshaft, (d) a valve spool mounted on the pumpshaft but rotatable relative to the pumpshaft, and (e) means selectively operative upon linear translation of the pumpshaft to rotate the valve spool back and forth between a first angular position in which the output of the pump is directed in one manner and a second angular position in which the output of the pump is directed in another manner.

12 Claims, 9 Drawing Figures

HYDRAULIC CONTROL SYSTEM HAVING RECIPROCATING PUMP AND HANDLE OPERATED ROTATING VALVE

TECHNICAL FIELD

This invention relates to a compact rotating hydraulic drive. In particular, it relates to a compact rotating hydraulic drive having a pumpshaft which is mounted for both linear translational and rotational movement.

BACKGROUND OF THE PRIOR ART

The subject hydraulic drive was developed to improve upon the pump disclosed in commonly assigned U.S. Pat. No. 3,787,087, the disclosure of which is incorporated herein by reference. It is specifically designed for replacement of the normal hydraulic system used to tilt truck cabs in order to provide access to the truck motor. However, as will be readily apparent, its utility is by no means limited to that environment.

OBJECTS OF THE INVENTION

It is a general object of the invention to provide a self-contained compact rotating hydraulic drive suitable for use in a cabtilt system.

It is a further object of the invention to provide such a compact rotating hydraulic drive which can be manually operated in the limited space between the front wheel and the mudguard of a truck.

It is a further object of the invention to provide such a compact rotating hydraulic drive which is less susceptible to dirt and road debris than are conventional pumps now in use.

It is still another object of the invention to provide such a hydraulic drive which is operable either manually or with the aid of an electric drive.

It is a further object of the invention to provide such a hydraulic drive which can be used with either a double-acting or a single-acting cylinder.

It is still another object of the invention to provide such a hydraulic drive which can be used for other purposes—for instance, as a garage tool.

BRIEF SUMMARY OF THE INVENTION

The subject invention is a compact rotating hydraulic drive comprising (a) a housing, (b) a pumpshaft mounted in the housing for both linear translational and rotational movement, (c), a plurality of pumping units operated by rotational motion of the pumpshaft, (d) a valve spool mounted on the pumpshaft but rotatable relative to the pumpshaft, and (e) means selectively operative upon linear translation of the pumpshaft to rotate the valve spool back and forth between a first angular position in which the output of the pump is directed in one manner and a second angular position in which the output of the hydraulic drive is directed in another manner.

BRIEF DESCRIPTION OF THE DRAWINGS

FIG. 2 is a fragmentary view similar to the lower portion of FIG. 1, except that the hydraulic drive is in position to pump the piston in.

FIG. 5B is a sectional view similar to FIG. 5A except that the spool is in position to pump the piston in.

DETAILED DESCRIPTION OF PRESENTLY PREFERRED EMBODIMENT

Figure 1:
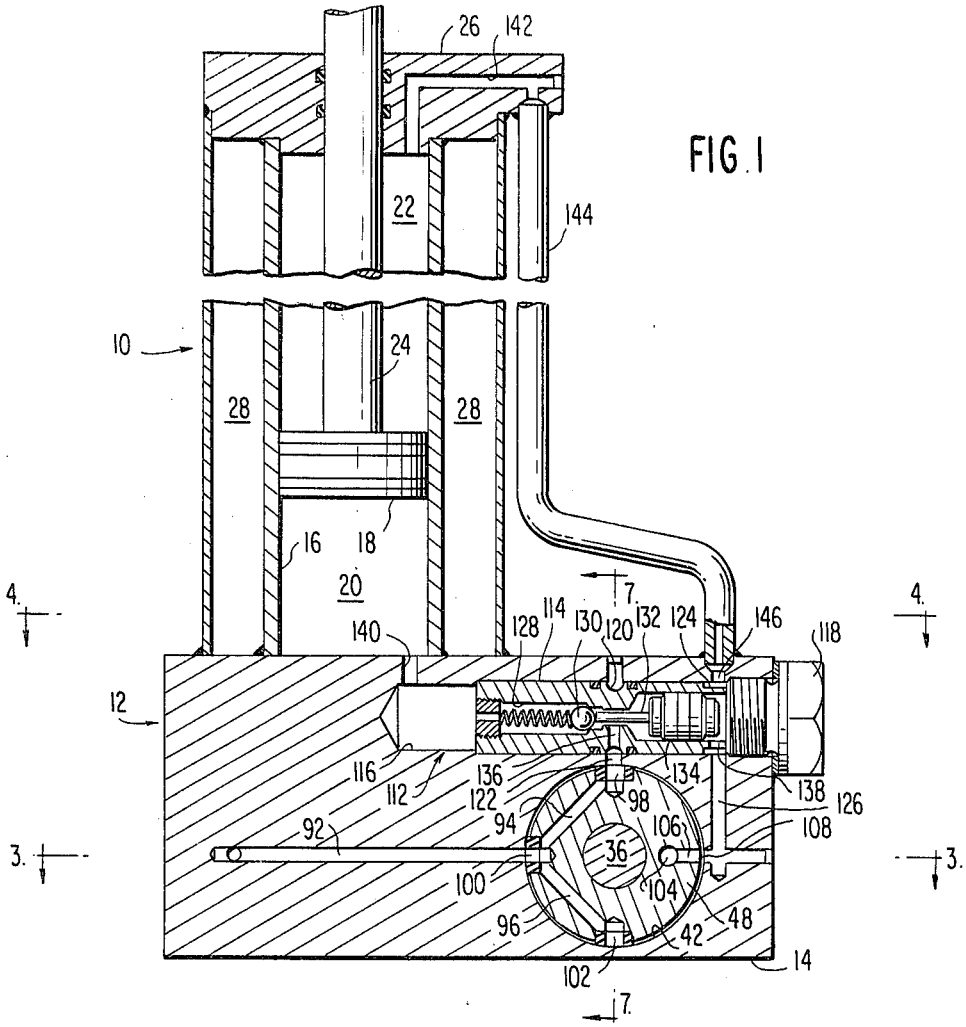
FIG. 1 is a cross-sectional view along the line 1—1 in FIG. 3 of the presently preferred embodiment of the subject invention with the hydraulic drive in position to pump the piston out.

The drawings show a double-acting cylinder 10 and a compact rotating hydraulic drive 12 contained in a housing 14. The illustrated double-acting cylinder 10 comprises a cylinder 16, a piston 18 slidably received in the cylinder 16 which divides the interior of the cylinder 16 into a push chamber 20 and a pull chamber 22, a rod 24 attached to the piston 18 and slidably received in an end cap 26, and a hydraulic fluid reservoir 28 which surrounds the cylinder 16. However, it is to be understood that the compact rotating hydraulic drive 12 can be used with a single-acting cylinder rather than the illustrated double-acting cylinder 10 or, indeed, in an environment in which it is not connected to a cylinder at all.

The compact rotating hydraulic drive 12 comprises at least one (in the illustrated embodiment, two) pumping barrels 30 (best seen in FIGS. 3 and 6) and a cam shaft 32 which is perpendicular to the pumping barrels 30. The cam shaft 32 comprises an externally operable handle 34 and a shaft 36 on which two pumping cams 38 are eccentrically mounted. The shaft 36 is biased towards a normal position (shown in FIGS. 3 and 7) by a wave washer 40. The wave washer 40 bears against the distal end of the shaft 36, but the shaft 36 is permitted to rotate relative to the wave washer 40.

The cam shaft 32 is received in a through bore 42 which is closed at one end by an end cap 44 and at the other end by an access plug 46 which is threadedly received in the housing 14. The wave washer 40 bears against the end cap 44, and the shaft 36 is slidably received in the access plug 46. The pumping cams 38 rotate freely in the through bore 42—that is, they do not contact the surface of the bore.

Figure 5A:
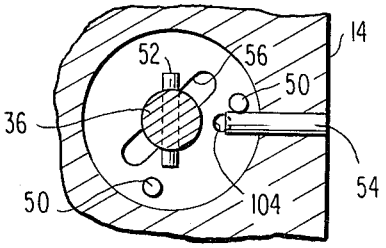
FIG. 5A is a sectional view along the line 5—5 in FIG. 3.
Figure 5B:
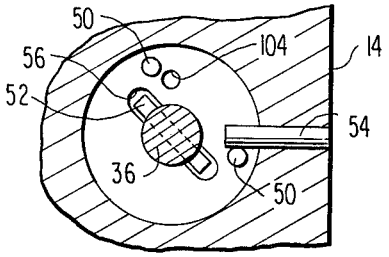
Figure 7:
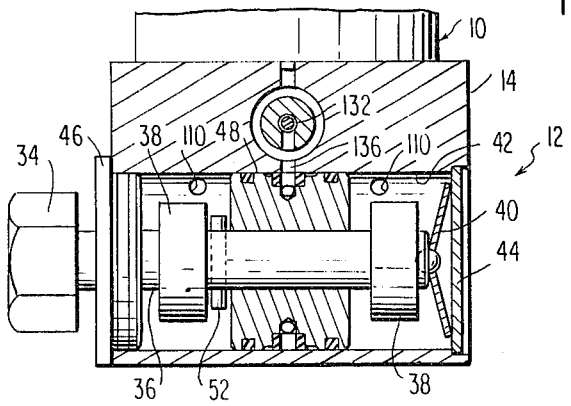
FIG. 7 is a sectional view along the line 7—7 in FIG. 1 with the pumpshaft in its normal position.
Figure 7A:
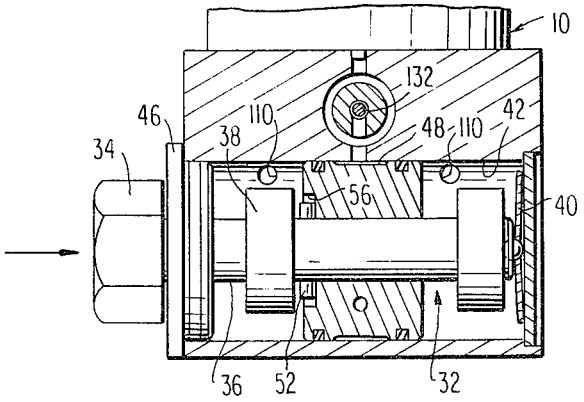
FIG. 7A is a sectional view similar to FIG. 7 except that the pumpshaft has been translated against the bias of the wave washer.

A valve spool 48 (described in detail hereinafter) is rotatably mounted on the shaft 36. Two pins 50 spaced apart by an angle of 90° relative to the central axis of the shaft 36 project eccentrically from each end of the valve spool 48. A single transverse pin 52 projects from both sides of the shaft 36 proximally of the valve spool 48, a pin 54 projects from the housing 14 between each pair of pins 50, and a relief 56 sized and shaped to receive the projecting ends of the pin 52 is formed in the proximal end of the valve spool 48. Thus, when the shaft 36 is moved to the right in FIGS. 7 and 7A against the bias of the wave washer 40 and rotated until the projecting ends of the pin 52 are received in the relief 56, further rotation of the shaft 36 causes rotation of the valve spool 48 through an excursion limited angularly by contact between each pin 54 and the corresponding pins 50. That is, the valve spool 48 can be rotated back and forth between the angular positions shown in FIGS. 5A and 5B. Once in either position, the valve spool 48 is maintained in place by friction.

Figure 6:
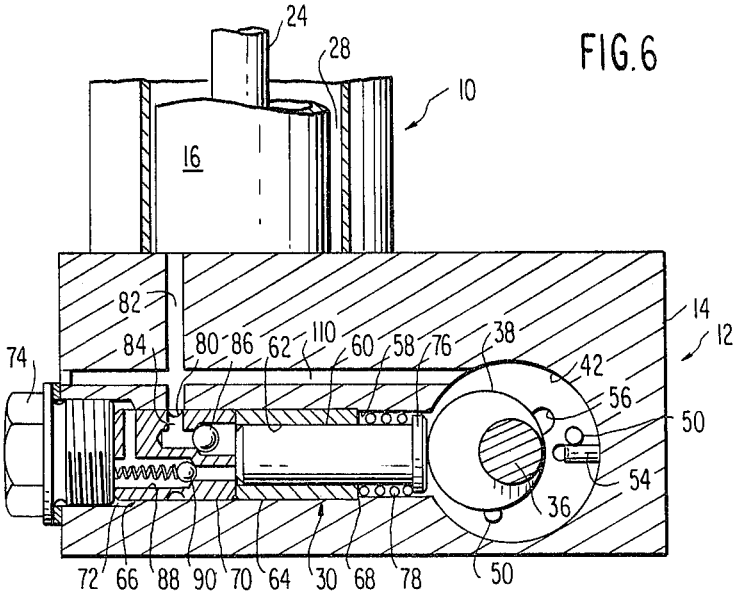
FIG. 6 is a sectional view along the line 6—6 in FIG. 3.

The pumping barrels 30 are received in two-stepped bores 58. As best seen in FIG. 6, each pumping barrel 30 comprises a pumping piston 60 slidably received in a bore 62 in a bearing 64. The bearing 64 in turn is slidably received in the middle portion of the corresponding two-stepped bore 58. Since the pumping barrels 30 are identical, only one will be described.

Each two-stepped bore 58 has annular abutments 66 and 68, and the bearing 64 is held against the abutment 68 by contact with a cylindrical valve housing 70 which is also slidably received in the middle portion of the two-stepped bore 58. The cylindrical valve housing 70 extends into the largest portion of the two-stepped bore 58, leaving an annular chamber 72 between the cylindrical valve housing 70 and the inner surface of the largest portion of the two-stepped bore 58. An access plug 74 is threadedly received in the annular chamber 72. The access plug 74 bears against the cylindrical valve housing 70, which in turn bears against the bearing 64, and that in turn bears against the abutment 68. Removal of the access plug 74 permits removal of the cylindrical valve housing 70, the bearing 64, and the pumping piston 60 for maintenance and replacement.

A head 76 is formed on the distal end of the pumping piston 60. The distal surface of the head 76 has a wear surface which is maintained in contact with the pumping cam 38 by a compression spring 78 which bears at one end against the bearing 64 and at the other end against the proximal surface of the head 76.

Figure 3:
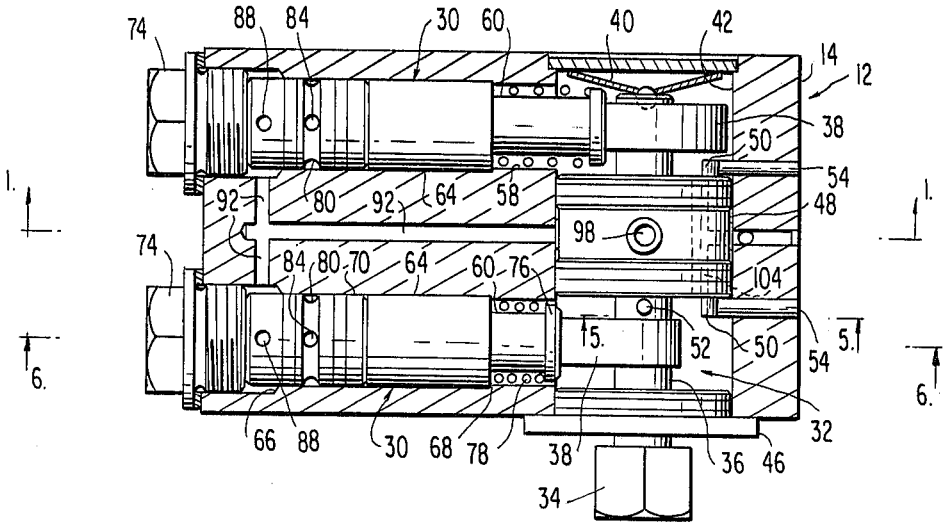
FIG. 3 is a sectional view along the line 3—3 in FIG. 1.
Figure 4:
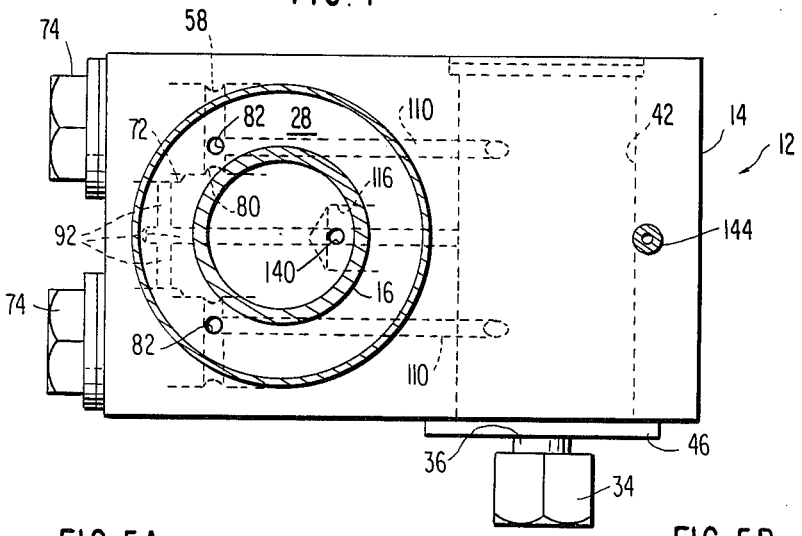
FIG. 4 is a sectional view along the line 4—4 in FIG. 1.

The cylindrical valve housing 70 has an annular relief 80 which is in fluid communication with the reservoir 28 by means of a fluid conduit 82. A fluid conduit 84 in the valve housing 70 containing a one-way valve 86 leads from the annular relief 80 to the distal end surface of the cylindrical valve housing 70, where it communicates with the bore 62. A second fluid conduit 88 containing a one-way valve 90 leads from the distal end surface of the cylindrical valve housing 70, where it also communicates with the bore 62, to the annular chamber 72. As best seen in FIG. 3, each annular chamber 72 is in communication with the valve spool 48 by a fluid conduit 92. The two fluid conduits 92 preferably join into a single bore, as illustrated in FIGS. 3 and 4. Thus, when the pumping cam 38 is rotated in either direction from the position shown in FIG. 6, the pumping piston 60 is forced to the right in FIG. 6 by the compression spring 78, creating a low pressure which permits hydraulic fluid from the reservoir 28 to open the one-way valve 86 and to flow into the bore 62 to the left of the pumping piston 60. Then, when the pumping cam 38 is rotated back to the position shown in FIG. 6, hydraulic fluid from the bore 62 closes the one-way valve 86, opens the one-way valve 90 and flows through the fluid conduit 92 to the valve spool 48.

The valve spool 48 is slidingly and rotatably received in the through bore 42. It is mounted on, but rotatable relative to, the shaft 36. As will be recalled, it can be rotated back and forth between the positions shown in FIGS. 1 and 2 by manipulation of the externally operable handle 34. Its axial position in the bore 42, however, is rather closely determined by the pins 54.

The valve spool 48 contains two chordal bores 94 and 96, both located in a plane perpendicular to the axis of the bore 42. The bore 94 leads chordally from a recess 98 on the circumferential surface of the valve spool 48 to a recess 100 on the circumferential surface of the valve spool 48 which is spaced from the recess 98 by an angle of 90° relative to the central axis of the shaft 36. The bore 96 leads chordally from the recess 100 to a recess 102 on the circumferential surface of the valve spool 48 which is spaced from the recess 100 by an angle of 90° relative to the central axis of the shaft 36.

The valve spool 48 also contains a through bore 104 which is perpendicular to the chordal bores 94 and 96 and which is located between the shaft 36 and the circumferential surface of the valve spool 48. A radial bore 106 in the plane of the chordal bores 94 and 96 extends from the through bore 104 to a point 108 on the circumferential surface of the valve spool 48 which is spaced for the recess 102 by an angle of 90° relative to the central axis of the shaft 36. Thus, the recesses 98, 100, and 102 and the point 108 are coplanar and equiangularly spaced around the circumferential surface of the valve spool 48.

In the position of the valve spool 48 shown in FIG. 1, pressurized hydraulic fluid from the fluid conduit 92 passes through the valve spool 48 via the chordal bore 94. Pressurized hydraulic fluid enters the chordal bore 96, but the recess 102 is not in fluid communication with another fluid conduit, so no hydraulic fluid flows through the chordal bore 96. At the same time, hydraulic fluid from the pull chamber 22 (which is being decreased in size by outward movement of the piston 18) passes through the valve spool 48 on its way to the reservoir 28 via the radial bore 106 and the through bore 104. Thus, hydraulic fluid at tank pressure fills the through bore 42 and the stepped bore 58 to the right of the bearing 64. From the through bore 42 the hydraulic fluid is returned to the reservoir 28 via fluid conduits 110 (one on either side of the valve spool 48) and fluid conduit 82.

Figure 2:
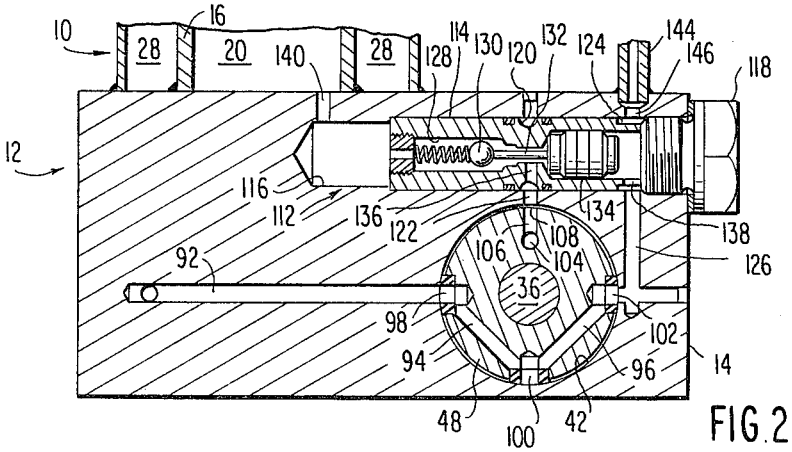

In the position of the valve spool 48 shown in FIG. 2, pressurized hydraulic fluid from the fluid conduit 92 passes through the valve spool 48 via the chordal bores 94 and 96. At the same time, hydraulic fluid from the push chamber 20 (which is being decreased in size by inward movement of the piston 18) passes through the valve spool 48 on its way to the reservoir 28 via the radial bore 106 and the through bore 104.

The last major component of the rotary pump 12 to be described is a pilot operated check valve 112 (shown in FIGS. 1 and 2) which normally closes off the path of the returning hydraulic fluid to the reservoir 28. It comprises a valve housing 114 held in position in a stepped bore 116 by an access plug 118. A first annular relief 120 on the valve housing 114 is in communication with the valve spool 48 via a bore 122, and a second annular relief 124 on the valve housing 114 is in communication with the valve spool 48 via a fluid conduit 126. The valve housing 114 contains a stepped axial through bore 128, and the through bore 128 contains a one-way valve 130 and a floating pin 132 carried by a floating piston 134. A bore 136 connects the annular relief 120 to the through bore 128 between the one-way valve 130 and the floating piston 134, and a bore 138 connects the annular relief 124 to the through bore 128 on the other side of the floating piston 134.

When the valve spool 48 is in the position shown in FIG. 1, pressurized hydraulic fluid from the recess 98 flows through the bore 122, the annular relief 120, and the bore 136 to the through bore 128. There it forces the floating piston 134 to the right against the access plug 118, and it opens the one-way valve 130, permitting pressurized hydraulic fluid to flow out through the left end of the through bore 128 into the bore 116 and from there through a bore 140 to the push chamber 20. At the same time, hydraulic fluid from the emptying pull chamber 22 flows through a passage 142 in the end cap 26, a hydraulic conduit 144 which connects the passage 142 to the housing 14, and a bore 146 which connects the hydraulic conduit 144 to the annular relief 124. From the annular relief 124, the hydraulic fluid flows to the reservoir 28 as previously described.

When the valve spool 48 is in the position shown in FIG. 2, pressurized hydraulic fluid from the recess 102 flows through the fluid conduit 126 to the annular relief 124. From there, some of it flows to the pull chamber 22 via the bore 146, the hydraulic conduit 144, and the passage 142. Some of the pressurized hydraulic fluid also flows from the annular relief 124 through the bore 138 to the through bore 128, where it forces the floating piston 134 to the left. Movement of the floating piston 134 to the left in turn causes the floating pin 132 to unseat the one-way valve 130, permitting hydraulic fluid from the emptying push chamber 20 to flow through the bore 140, the bore 116, the through bore 128, the bore 136, the annular relief 120, and the bore 122 to the point 108. From the point 108, the hydraulic fluid flows to the reservoir 28 as previously described.

It should be particularly noted that, if rotation of the pumpshaft 32 ceases during utilization of the pump while the valve spool 48 is in the position shown in FIG. 2, pressure will immediately stop in the through bore 128 above the floating piston 134. The drop in pressure in the through bore 128 in turn causes the one-way valve 130 to close, blocking return of hydraulic fluid from the push chamber 20 to the reservoir 28. Thus, the piston 18, the rod 24, and whatever load is attached to the rod 24 will all remain in place until pumping is resumed.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. A compact rotating hydraulic drive comprising:

a housing;

a cam shaft in said housing for both linear translational and rotational movement;

at least one pumping cam mounted on said cam shaft;

at least one pumping unit comprising a pumping piston mounted in said housing for linear reciprocation, said pumping piston being operatively controlled by said at least one pumping cam such that rotation of said at least one pumping cam causes linear reciprocation of said pumping piston;

a valve spool mounted on said cam shaft but rotatable relative to said cam shaft;

first means selectively operable upon linear translation of said cam shaft to rotate said valve spool back and forth between a first angular position and a second angular position;

a first path of fluid communication connecting said at least one pumping unit to said valve spool;

a second path of fluid communication in said valve spool connecting said first path of fluid communication to a load when said valve spool is in its first angular position;

a third path of fluid communication in said valve spool connecting said first path of fluid communication to a load when said valve spool is in its second angular position; and a fourth path of fluid communication in said valve spool for returning hydraulic fluid to tank when said valve spool is in its first or second angular position.

2. A compact rotating hydraulic drive as recited in claim 1 and further comprising second means operable externally of said housing for selectively causing linear translational and rotational movement of said cam shaft.

3. A compact rotating hydraulic drive as recited in claim 1 wherein said at least one pumping unit further comprises:

a fifth path of fluid communication containing a first one-way valve which opens upon translation of said pumping piston in one way, permitting hydraulic fluid to enter a pumping chamber; and a sixth path of fluid communication containing a second one-way valve which opens upon translation of said pumping piston in the other way, forcing hydraulic fluid to leave said pumping chamber.

4. A compact rotating hydraulic drive as recited in claim 1 wherein:

said second path of fluid communication comprises a first bore extending chordally from a first point on the circumferential surface of said valve spool to a second point on the circumferential surface of said valve spool;

said fourth path of fluid communication comprises a longitudinal bore extending through said valve spool; and said third path of fluid communication comprises a second bore extending chordally from the second point on the circumferential surface of said valve spool to a third point on the circumferential surface of said valve spool.

5. A compact rotating hydraulic drive as recited in claim 1 and further comprising a check valve which normally closes off the path of returning hydraulic fluid to tank.

6. A compact rotating hydraulic drive comprising:

a housing;

a cam shaft mounted in said housing for rotational movement;

at least one pumping cam mounted on said cam shaft;

at least one pumping unit comprising a pumping piston mounted in said housing for linear reciprocation, said pumping piston being operative controlled by said at least one pumping cam such that rotation of said least one pumping cam causes linear reciprocation of said pumping piston; a valve spool mounted in said housing;

first means for selectively moving said valve spool back and forth between a first position and a second position;

a first path of fluid communication connecting said at least one pumping unit to said valve;

a second path of fluid communication through said valve connecting said first path of fluid communication to a load when said valve is in its first position;

a third path of fluid communication through said valve connecting said first path of fluid communication to a load when said valve is in its second position;

a fourth path of fluid communication through said valve for returning hydraulic fluid to tank when said valve is in its first or second position;

said valve comprises a valve spool rotatably mounted in said housing;

said second path of fluid communication comprises a first bore extending chordally from a first point on the circumferential surface of said valve spool to a second point on the circumferential surface of said valve spool;

said fourth path of fluid communication comprises a longitudinal bore extending through said valve spool; and said third path of fluid communication comprises a second bore extending chordally from the second point on the circumferential surface of said valve spool to a third point on the circumferential surface of said valve spool.

7. A compact rotating hydraulic drive as recited in claim 6 and further comprising second means operable externally of said housing for selectively causing rotational movement of said cam shaft.

8. A compact rotating hydraulic drive as recited in claim 6 wherein said at least one pumping unit further comprises:

a fifth path of fluid communication containing a first one-way valve which opens upon translation of said pumping piston in one way, permitting hydraulic fluid to enter a pumping chamber; and a sixth path of fluid communication containing a second one-way valve which opens upon translation of said pumping piston in the other way, forcing hydraulic fluid to leave said pumping chamber.

9. A compact rotating hydraulic drive as recited in claim 6 and further comprising a check valve which normally closes off the path of returning hydraulic fluid to tank.

10. A compact rotating hydraulic drive comprising:

a housing;

a cam shaft mounted in said housing for rotational movement;

at least one pumping unit operatively controlled by said cam shaft such that rotation of said cam shaft actuates said at least one pumping unit;

a valve mounted in said housing;

first means for selectively moving said valve back and forth between a first position and a second position;

a first path of fluid communication connecting said at least one pumping unit to said valve;

a second path of fluid communication through said valve connecting said first path of fluid communication to a load when said valve is in its first position;

a third path of fluid communication through said valve connecting said first path of fluid communication to a load when said valve is in its second position;

a fourth path of fluid communication through said valve for returning hydraulic fluid to tank when said valve is in its first or second position;

said valve comprises a valve spool rotatably mounted in said housing;

said second path of fluid communication comprises a first bore extending chordally from a first point on the circumferential surface of said valve spool to a second point on the circumferential surface of said valve spool;

said fourth path of fluid communication comprises a longitudinal bore extending through said valve spool; and said third path of fluid communication comprises a second bore extending chordally from the second point on the circumferential surface of said valve spool to a third point on the circumferential surface of said valve spool.

11. A compact rotating hydraulic drive as defined in claim 10 and further comprising a check valve which normally closes off the path of returning hydraulic fluid to tank.

12. A compact rotating hydraulic drive as recited in claim 10 and further comprising second means operable externally of said housing for selectively causing rotational movement of said cam shaft.

* * * * *